US008002045B2

(12) United States Patent
Ezell et al.

(10) Patent No.: US 8,002,045 B2
(45) Date of Patent: Aug. 23, 2011

(54) DOWNHOLE TOOL WITH LOAD DIVERTING SYSTEM AND METHOD

(75) Inventors: Michael Dale Ezell, Carrollton, TX (US); Gary Dale Ellis, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 138 days.

(21) Appl. No.: 12/203,013

(22) Filed: Sep. 2, 2008

(65) Prior Publication Data

US 2010/0051293 A1 Mar. 4, 2010

(51) Int. Cl.
*E21B 33/12* (2006.01)
*E21B 23/00* (2006.01)

(52) U.S. Cl. ..... 166/387; 166/382; 166/212

(58) Field of Classification Search ..... 166/387, 166/382, 120, 134, 138, 212, 301, 98
See application file for complete search history.

(56) References Cited

U.S. PATENT DOCUMENTS

| | | | | |
|---|---|---|---|---|
| 2,159,640 | A * | 5/1939 | Strom | 166/122 |
| 2,711,795 | A * | 6/1955 | Ragan | 166/120 |
| 3,002,561 | A * | 10/1961 | Baker et al. | 166/120 |
| 3,951,211 | A | 4/1976 | Ellis | |
| 4,044,826 | A | 8/1977 | Crowe | |
| 4,305,465 | A | 12/1981 | Ellis | |
| 4,363,358 | A | 12/1982 | Ellis | |
| 4,372,527 | A | 2/1983 | Rosehauch et al. | |
| 4,691,775 | A | 9/1987 | Lustig et al. | |
| 4,730,835 | A * | 3/1988 | Wilcox et al. | 277/342 |
| 5,086,839 | A | 2/1992 | Setterberg, Jr. et al. | |
| 5,662,341 | A | 9/1997 | Ezell et al. | |
| 6,056,052 | A | 5/2000 | Mullen et al. | |
| 6,167,963 | B1 | 1/2001 | McMahan et al. | |
| 6,648,335 | B1 | 11/2003 | Ezell | |
| 6,924,745 | B2 | 8/2005 | Schultz et al. | |
| 2002/0121380 | A1 * | 9/2002 | Doane et al. | 166/382 |
| 2003/0226660 | A1 | 12/2003 | Winslow et al. | |
| 2003/0231117 | A1 | 12/2003 | Schultz et al. | |
| 2005/0189103 | A1 | 9/2005 | Roberts et al. | |
| 2007/0227745 | A1 * | 10/2007 | Roberts et al. | 166/386 |
| 2007/0246227 | A1 | 10/2007 | Ezell et al. | |
| 2008/0190600 | A1 | 8/2008 | Shkurti et al. | |

FOREIGN PATENT DOCUMENTS

GB 2443992 A 5/2008

OTHER PUBLICATIONS

Notification of Transmittal of the International Search Report and the Written Opinion of the International Searching Authority of the Declaration (3 pages), International Search Report (4 pages), and Written Opinion of the International Searching Authority (6 pages) in counterpart application PCT/US2009/055502, dated Dec. 23, 2009.

* cited by examiner

*Primary Examiner* — William P Neuder
*Assistant Examiner* — Cathleen R Hutchins
(74) *Attorney, Agent, or Firm* — Joshua Griswold

(57) ABSTRACT

A downhole tool for providing a seal downhole within a wellbore for reducing loading experienced by a sealing member of the downhole tool is disclosed. The downhole tool may include a pair of directional locking members, at least one of which is operable to transfer a loading experienced by the downhole tool through rigid components of the downhole tool, thereby bypassing the sealing member.

23 Claims, 16 Drawing Sheets

RUN CONFIGURATION

RUN CONFIGURATION

DOWNHOLE TOOL WITH LOAD DIVERTING SYSTEM AND METHOD

TECHNICAL FIELD

This disclosure relates to securing a downhole tool at a location downhole, and more particularly to systems and methods for securing a downhole tool, such as a packer, within a well casing.

BACKGROUND

Downhole tools, such as packers, straddle packers, fracturing plugs ("frac plugs"), and bridge plugs, may be secured in place down hole to isolate one or more portions of a wellbore from one or more other portions of a wellbore.

SUMMARY

A downhole tool according to one aspect includes an elongated mandrel, a first slip assembly carried on the mandrel, and a second slip assembly carried on the mandrel. The first slip assembly may include a first slip radially extendable to grip a wall of a wellbore and a first engaging portion. The first engaging portion may be adapted to grip the mandrel against relative movement in a first axial direction and allow relative movement of the mandrel in a second axial direction. The second slip assembly may include a second slip radially extendable to grip the wall of the wellbore and a second engaging portion. The second engaging portion may be adapted to grip the mandrel against relative movement in the first axial direction and allow relative movement of the mandrel in the second axial direction. The downhole tool also includes a sealing element carried on the mandrel adapted to engage the wall of the wellbore.

Another aspect includes a method for diverting loading in a first direction around a sealing element of a downhole tool. The method includes applying a setting load in a first direction through a mandrel to extend a sealing element into contact with an adjacent surface and form a first gripping engagement with the adjacent surface on a first side of the sealing element indicated by the first direction and second gripping engagement with the adjacent surface on a second side of the sealing element opposite the first direction. The method also includes communicating loading through the mandrel in the first direction through the sealing element and the first gripping engagement, and communicating loading through mandrel in the second direction through the second gripping engagement and bypassing the sealing element.

A further aspect includes a downhole tool configurable between an unset and set configuration and adapted to provide a seal downhole. The downhole tool includes an elongated mandrel and a first slip assembly carried on the mandrel comprising a first engagement portion, a first radially expandable engagement member adapted to grip the wall of the wellbore and a first wedge adapted to expand the first radially expandable engagement member. The downhole tool also includes a second slip assembly carried on the mandrel comprising a second engagement portion, a second radially expandable engagement member adapted to grip the wall of the well bore and a second wedge adapted to expand the second radially expandable engagement member. A sealing element may be carried on the mandrel and disposed between the first slip assembly and the second slip assembly. The sealing member may be adapted to radially expand to engage a wall of a wellbore. A first load path extending through the second engagement portion and bypassing the sealing element in the set configuration to conduct loading applied to the mandrel in the first axial direction, and a second load path extending through the sealing element and the first engagement portion in the set configuration to conduct loading applied to the mandrel in the second axial direction.

The various aspects may include one or more of the following features. The sealing element may be positioned between the first slip assembly and the second slip assembly. The first slip assembly and the second slip assembly may cooperate to form a first load path bypassing the sealing element when the mandrel is loaded in the first axial direction and a second load path including the sealing element when the mandrel is loaded in the second axial direction. One of the first engaging portion or the second engaging portion comprises may include a wedge that grips the mandrel. At least one of the first slip assembly, the second slip assembly, or the sealing element may be adapted to be actuated fluidically. At least one of the first slip assembly, the second slip assembly, or the sealing element may be adapted to be actuated by a wireline actuation tool. At least one of the first engaging portion or the second engaging portion may be adapted to ratchet in the second axial direction relative to the mandrel.

The various aspects may also include one or more of the following features. The adjacent surface is an interior surface of a wellbore casing. Forming the first gripping engagement with the adjacent surface may include radially expanding a first engagement member on the first side of the sealing element to grip the adjacent surface, and forming the second gripping engagement with the adjacent surface may include radially expanding a second engagement member on the second side of the sealing element to grip the adjacent surface. Radially expanding the first engagement member may include ratcheting the first engagement member along a length of the mandrel in a second direction opposite the first direction. Radially expanding the second engagement member may include ratcheting the second engagement member along a length of the mandrel in a second direction opposite the first direction. Applying the setting load in the first direction may include fluidically applying the setting load.

The various aspects may further include one or more of the following features. The first slip assembly and the second slip assembly may cooperate to radially expand the sealing element. At least one of the first slip assembly or the second slip assembly may be adapted to ratchet along the mandrel in the first axial direction. At least one of the first slip assembly, the second slip assembly, or the sealing element may be adapted to be actuated fluidically. At least one of the first engagement portion or the second engagement portion may include a locking ring disposed adjacent the mandrel and operable to ratchet along the mandrel in the first axial direction. At least one of the first engagement portion or the second engagement portion may include a wedge. The downhole tool may include a housing carried on the mandrel and a channel having a substantially zero internal pressure formed between the housing and the mandrel. The first engagement portion may be adapted to grip the mandrel against relative movement in a first axial direction and allow relative movement of the mandrel in a second axial direction opposite the first axial direction. The second engagement portion may be adapted to grip the mandrel against relative movement in a first axial direction and allow relative movement of mandrel in a second axial direction opposite the first axial direction.

The details of one or more implementations are set forth in the accompanying drawings and the description below. Other features, objects, and advantages will be apparent from the description and drawings, and from the claims.

DETAILED DESCRIPTION

Figure 1:
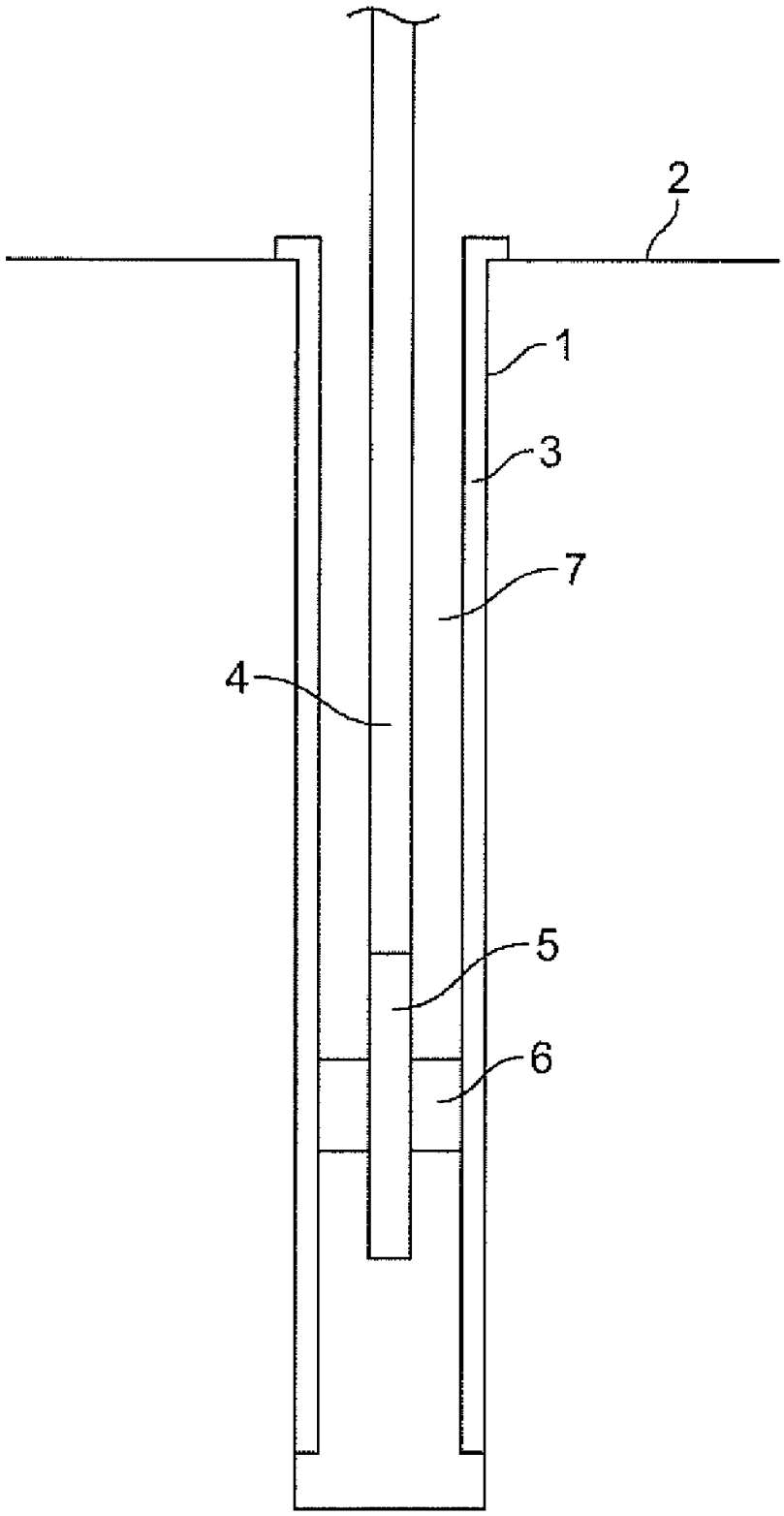
FIG. 1 shows a schematic of a wellbore extending from a terranean surface and having a downhole tool disposed therein.

The present disclosure encompasses a downhole tool for isolating a portion of a wellbore. An example configuration of an application of the downhole tool is illustrated in FIG. 1. FIG. 1 shows a wellbore 1 extending from a terranean surface 2. A wellbore casing 3 extends along a least a portion of the wellbore 1. The casing 3 may be cemented or otherwise secured into place within the wellbore 2. A downhole system 4 extends into the wellbore 1 and includes a downhole tool 5, for example, extending from a tubular working string, a wireline or other. The downhole tool 5 may be a sealing tool operable to seal or substantially seal against flow through an annulus 6 formed between the downhole tool 5 and the wellbore casing 3 when the downhole tool 5 is placed in a set configuration. Once set, the downhole tool 5 is operable to transmit force applied to the downhole tool 5 in one direction through the rigid components of the downhole tool, thus, bypassing a resilient sealing element 6 of the downhole tool 5. In the opposite direction, the force is transmitted through resilient member 6 of the downhole tool 5.

Figure 2A:
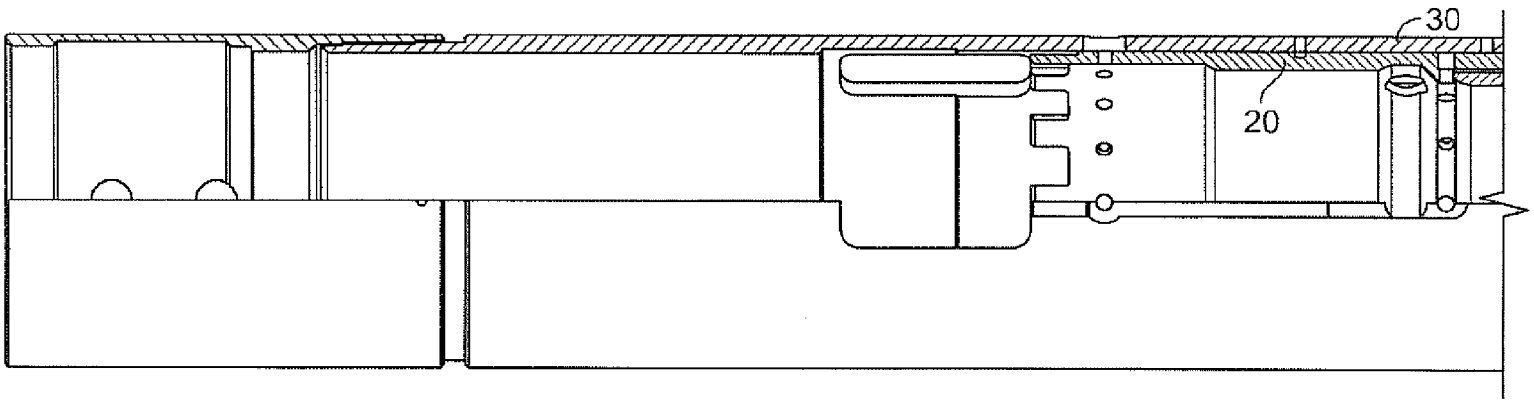
FIGS. 2A-C show an example downhole tool in the running configuration that is actuated by a wireline actuation tool and set from the top-down.
Figure 2B:
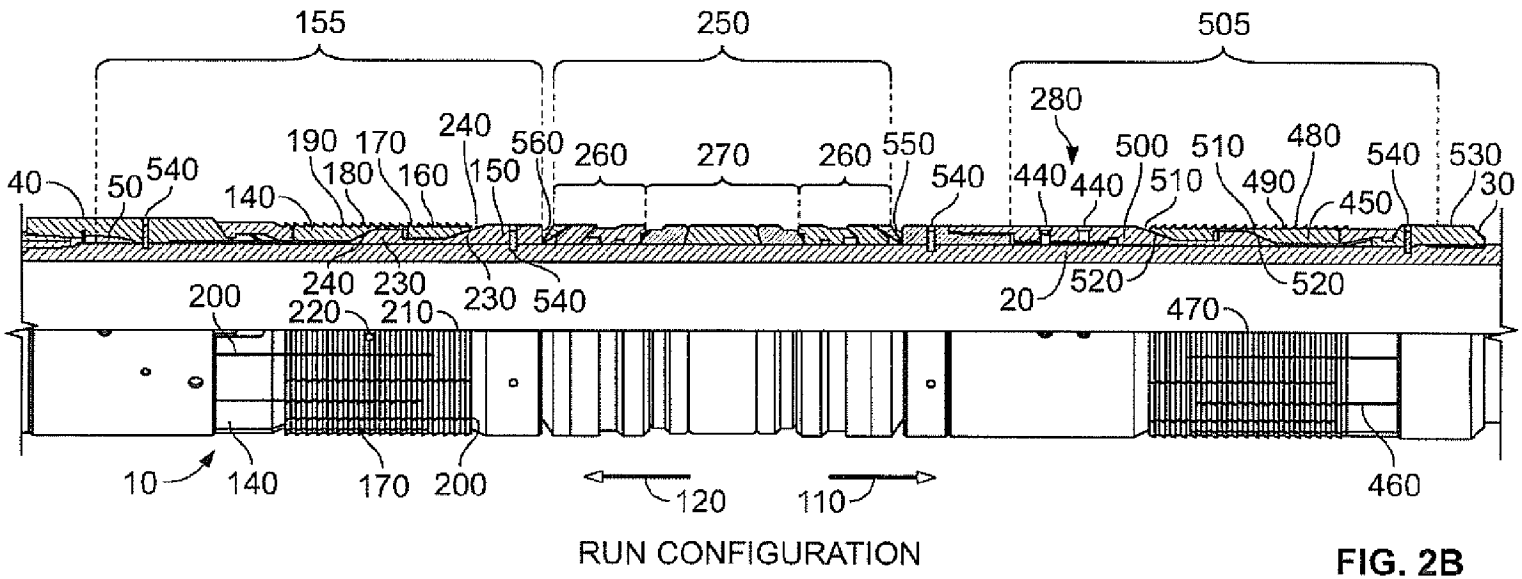
Figure 2C:
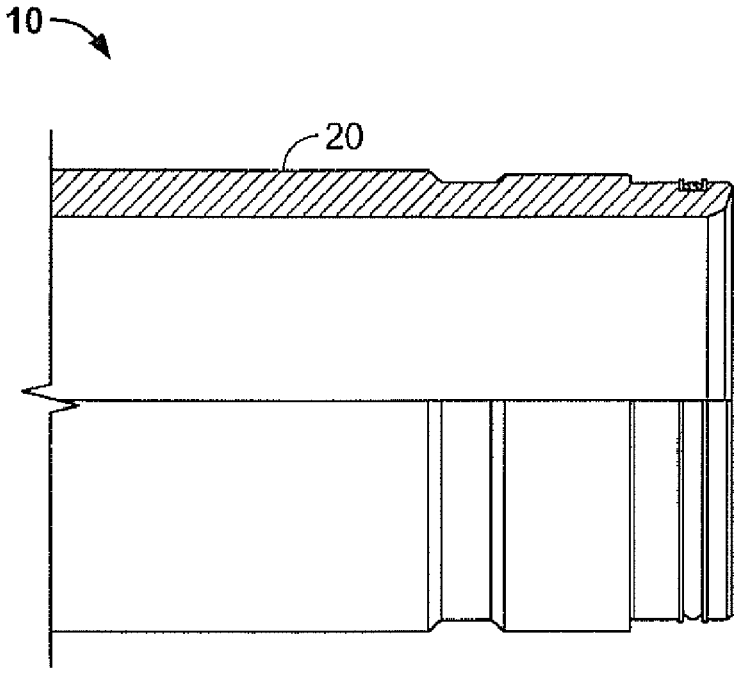
Figure 3C:
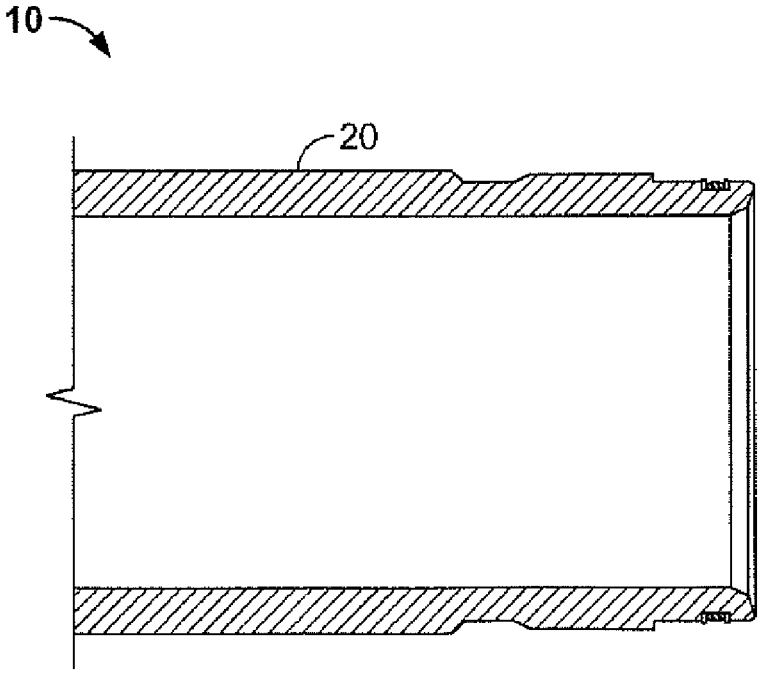
FIGS. 3A-C show the example downhole tool of FIGS. 2A-C in the set configuration.
Figure 3A:
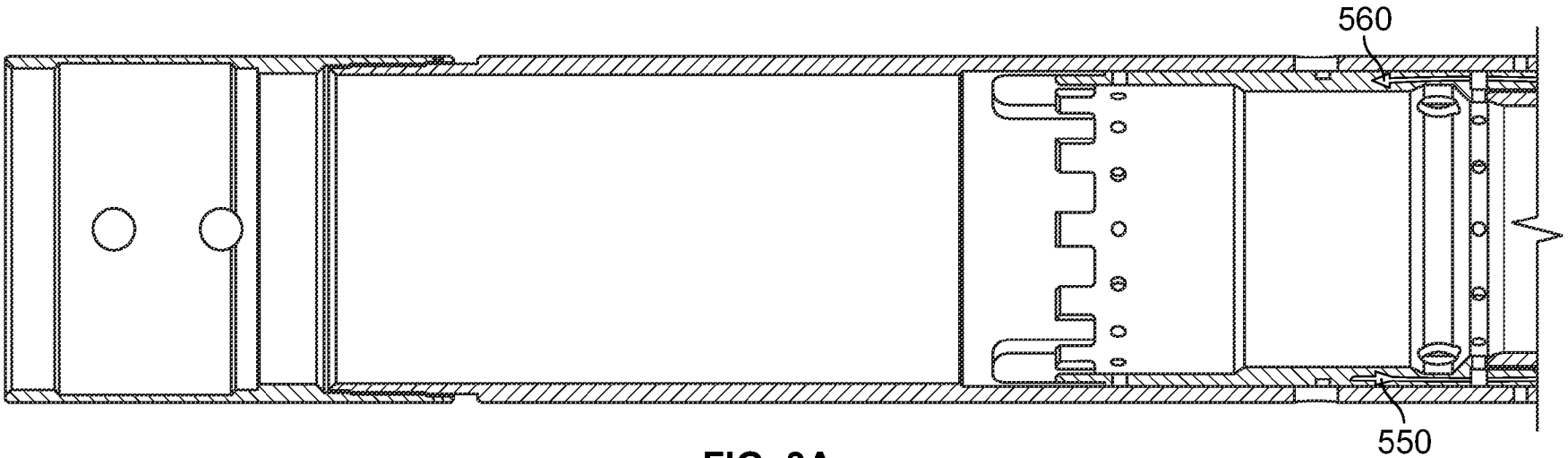
Figure 3B:
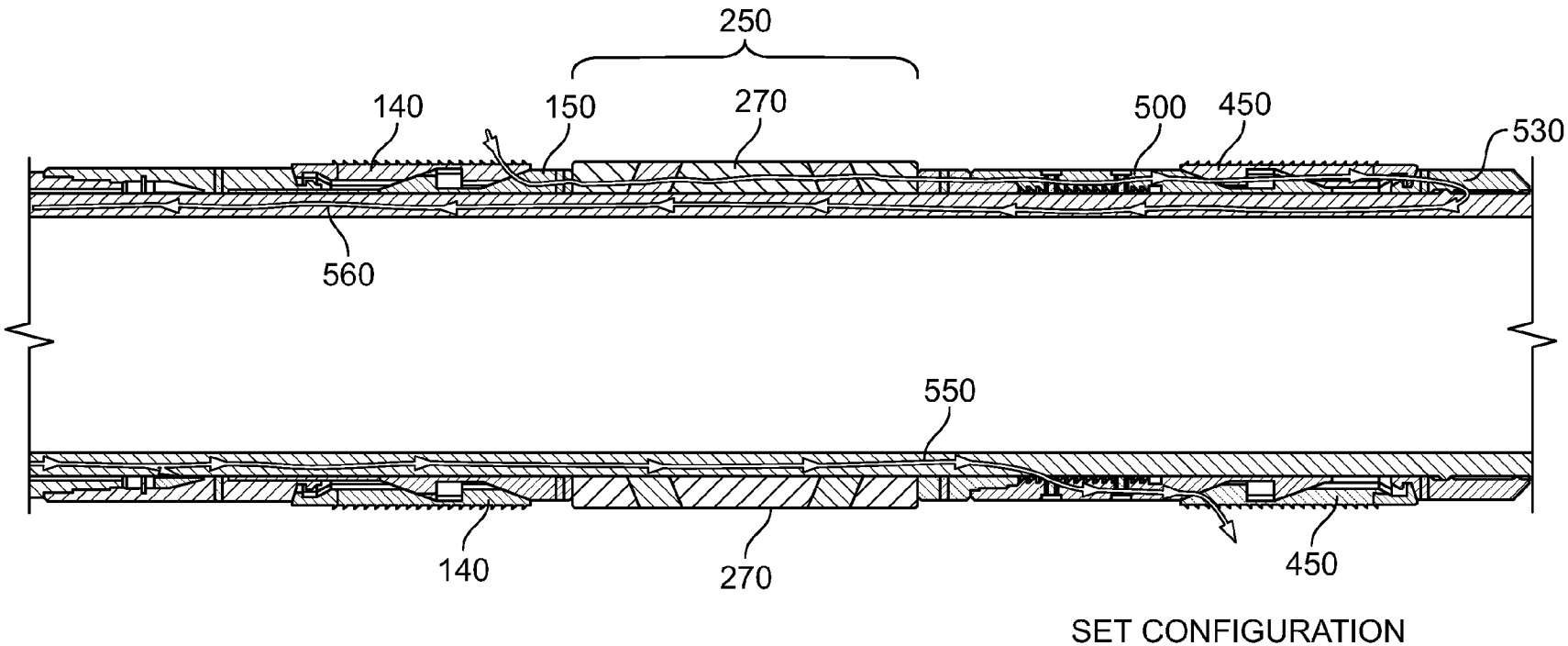

FIGS. 2A-C and 3A-C show an example downhole tool 10 that may be used as the downhole tool 5, shown in FIG. 1. FIGS. 2A-C show a partial cross-sectional view of the downhole tool 10 in an unset or "running" configuration, and FIGS. 3A-C show the downhole tool 10 in a set configuration. The downhole tool 10 is maintained in the running configuration when the downhole tool 10 is being placed into a desired location within the wellbore. The set configuration represents the downhole tool 10 after being set into position within the wellbore. The downhole tool 10 shown in FIGS. 2A-C is a wireline-actuated tool. However, in certain instances the downhole tool may be adapted to be actuated in other manners, for example, fluidically (hydraulically and/or hydrostatically) actuated, mechanically actuated by manipulating a tubing coupled to the downhole tool and/or otherwise actuated. Examples of fluidically actuated downhole tools 10 are discussed in more detail with respect to FIGS. 7A-D, 8A-D, 9A-D, and 10A-C.

The downhole tools described herein could, in some instances, be a packer. In other instances, the downhole tools could be configured as a frac plug for primarily sealing in one direction. In some instances, a frac plug may include only one expansion member, such as expansion member 260, on one side of a resilient sealing member, such as resilient sealing member 270. In still other instances, the downhole tools described herein could be configured as a bridge plug by blocking the internal passage of the tubular mandrel, such as tubular mandrel 20, described below.

Referring again to FIGS. 2A-C and 3A-C, the downhole tool 10 includes a tubular mandrel 20 that may be formed of a plurality of tubular elements coupled to each other, for example, by threaded connections, welding, or other joining technique. Alternately, the tubular mandrel 20 may be a single unitary tubular body, subject to manufacturing requirements. The downhole tool 10 may also include a tubular housing 30 circumjacent the tubular mandrel 20 and slideable relative thereto. The tubular housing 30 may also be formed from a plurality of tubular portions connected, for example, by threaded connections, welding, or other joining technique. The downhole tool 10 shown in FIGS. 2A-C and 3A-C is referred to as being set from the "top-down," because, when placing the downhole tool 10 into the set configuration, the tubular housing 30 is moved downhole and the tubular mandrel 20 is moved uphole. With reference to FIGS. 2A-C and 3A-C, if the uphole location (i.e., towards the terranean surface) is considered to be on the left side of the figure, as indicated), the tubular housing 30 is moved in the direction of arrow 110 and/or the tubular mandrel 20 is moved in the direction of arrow 120 when placing the downhole tool 10 in the set configuration. Other implementations may be considered to be set from "bottom-up" (such as the downhole tool 10 shown in FIGS. 9A-D and 10A-C), because, when placing the downhole tool 10 in the set configuration, the tubular housing 30 is moved uphole (i.e., to the left side of the FIGS. 9A-D, and 10A-C) and/or the tubular mandrel 20 is moved downhole (i.e., to the right side of FIGS. 9A-D, and 10A-C).

Figure 4:
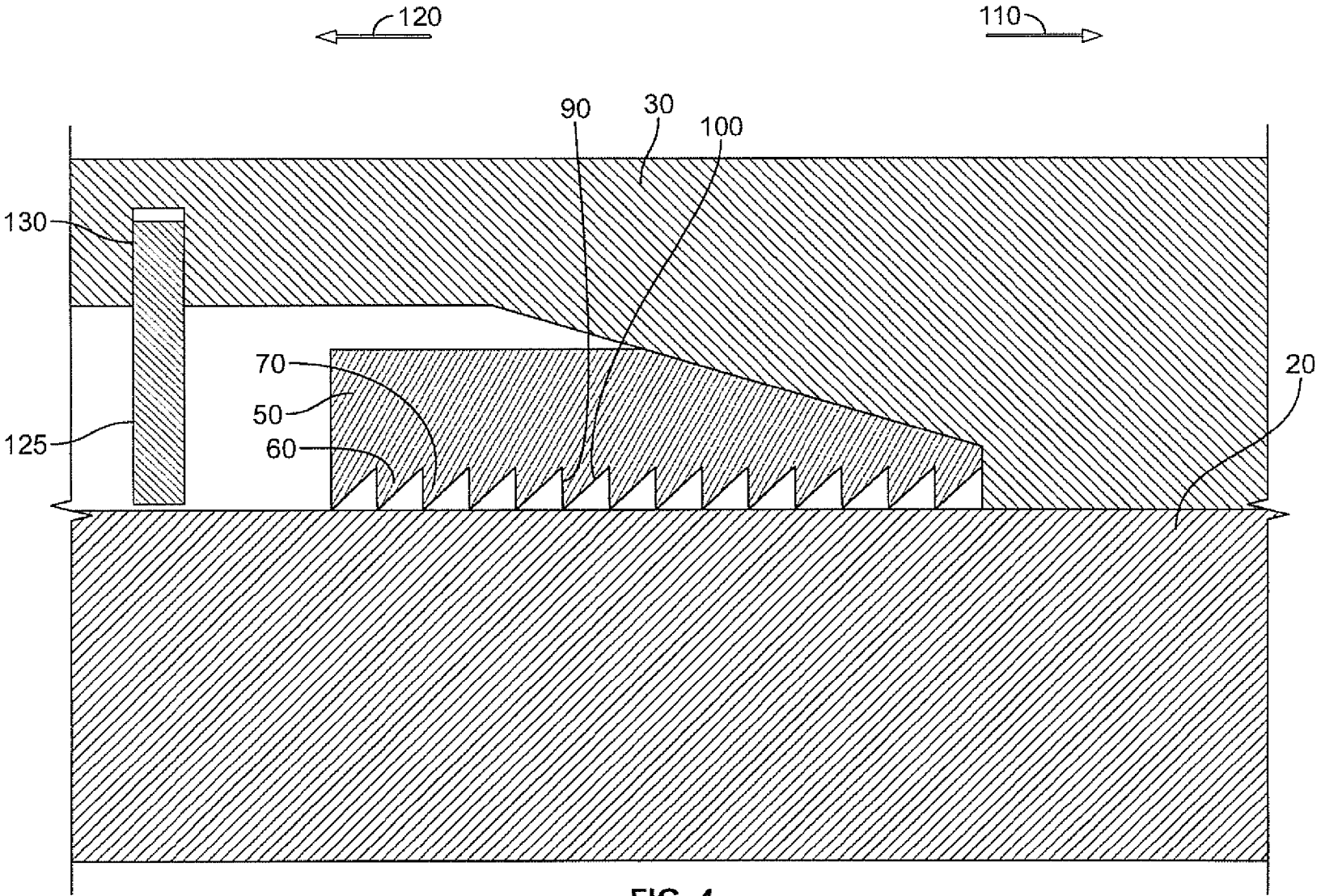
FIG. 4 shows a detail view of an example slip ring of the downhole tool shown in FIGS. 2A-C and 3A-C.

Near a first end portion 40 of the tubular housing 30, a slip ring 50 is disposed between the tubular mandrel 20 and the tubular housing 30. In some implementations, the slip ring 50 may be wedge-shaped. The slip ring 50 includes an engaging portion 60 formed of a plurality of engaging members or teeth 70. A detail view of the slip ring 50 is shown in FIG. 4. According to some implementations, the teeth 70 are a plurality of asymmetrical teeth. The teeth 70 may form a saw tooth pattern and configured to permit movement of the slip ring 50 relative to the tubular mandrel 20 in one direction but prevent movement of the slip ring 50 relative to the tubular mandrel 20 in an opposite direction. The plurality of asymmetrical teeth 70 may be formed from a plurality of coaxial annular rings or one or more continuous helical threads formed on the interior surface of the slip ring 50. As shown, the asymmetrical shape of the teeth 70 may form a saw tooth pattern having a vertical or substantially vertical side 90 and a sloped side 100. However, the shape of the teeth 70 shown in FIG. 4 is merely one example. Thus, the teeth 70 may have other shapes.

The slip ring 50 may also include one or more slits (not shown) formed at an edge of the slip ring 50, extending through the slip ring 50 and terminating at a distance along the length of the slip ring. Alternating slits formed in the slip ring 50 may have an origin at opposite edges of the slip ring 50 and have terminating ends within the slip ring 50 near opposite ends thereof. Alternately or in addition, the slip ring 50 may include another slit extending entirely through the length of the slip ring 50 resulting in the slip ring 50 having a "C" shape in profile. The slits allow the slip ring 50 to elastically expand radially without yielding. A retaining ring 125, shown residing in a groove 130 in the tubular housing 30, may be included to prevent the first retaining ring 50 from being removed from downhole tool 10 during manufacturing and/or assembly and to drive the slip ring 50 along the exterior surface of the tubular mandrel 20.

The configuration of the teeth 70 permits the slip ring 50 to move along the exterior surface of the tubular mandrel 20 in the direction of arrow 110. However, movement of the slip ring 50 in the direction of arrow 120 causes the teeth to "bite" into the tubular mandrel 20 resulting in an increase in friction that resists movement. Thus, the orientation of the teeth 70 of the slip ring 50 defines the direction in which movement of the slip ring 50 is facilitated. As a general matter, the slip ring 50 is capable of moving in a direction corresponding to the side of the teeth 70 having a shallow angle (in this case, side 100) and resists movement in a direction corresponding to the side of the teeth 70 having a vertical or substantially vertical side (in this case, side 90). A shallow angle defined at an interface between the slip ring 50 and the housing 90 also contributes to the ability of the slip ring 50 to grip the tubular mandrel 20 in one direction while moving relative to the tubular mandrel 20 in the opposite direction.

Continuing along the downhole tool 10, a first slip 140 is retained around the tubular mandrel 20, sandwiching a first wedge ring 150 between the first slip 140 and the tubular mandrel 20. The first slip 140, wedge ring 150, and slip ring 50 form a slip assembly 155. Similar to the slip ring 50, the first slip 140 includes an engaging portion 160. As shown, the engaging portion 160 includes a plurality of engaging members or teeth 170 disposed on an exterior surface of the first slip 140. The teeth 170 may be asymmetrical in shape. Similar to the teeth 70, described above, the teeth 170 include a sloped side 180 and a vertical or substantially vertical side 190. The teeth 170 provide for locking engagement with a wellbore casing when the first slip 140 is in an extended position. In the extended position, the first slip 140 resists movement of the downhole tool 10 relative to the wellbore casing in a direction corresponding to arrow 120. The teeth 170 may be formed from a plurality of adjacent coaxial annular rings or one or more continuous helical threads. The first slip 140 also includes a plurality of longitudinal slits 200 extending from an edge of the first slip 140 and ending at a location within the first slip 140 near an opposing edge of the first slip 140. Adjacent slits 200 extend from opposing edges of the first slip 140. Additionally, the first slip 140 includes another slit 210 extending longitudinally through first slip 140 along an entire length thereof so that the first slip 140 forms a "C" shape in profile. Shear pins 220 may be provided on opposing sides of the slit 210 to retain the first slip 140 in position in an unset or "run" configuration prior to setting the downhole tool 10 in position within the wellbore casing. (It is noted that only one of the shear pins 220 is illustrated in FIG. 2B due to the partial cross-sectional view presented.) That is, the shear pins 220 temporarily fix the first slip 140 in position as the downhole tool 10 is being run into the wellbore and prior to being placed into a desired location downhole. The slits 200 and 210 facilitate outward radial expansion of the first slip 140 when the downhole tool 10 is placed in a set configuration, i.e., the downhole tool 10 is fixed within the wellbore casing. The first wedge ring 150 has a pair of wedge-shaped protrusions 230 that nest within wedge-shaped recesses 240 formed in the first slip 140. The first wedge ring 150 may include more or fewer wedge-shaped protrusions extending into corresponding wedge-shaped recesses formed in the first slip 140.

Adjacent the first slip 140 and first wedge ring 150 is a sealing assembly 250 that may be expanded into sealing engagement with the wellbore casing when the downhole tool 10 is placed in the set configuration. In some implementations the sealing assembly 250 may be a packer. As shown, the sealing assembly 250 may include expansion members 260 and a resilient sealing element 270. The expansion members 260 are operable to eliminate or substantially reduce axial extrusion of the resilient sealing element 270. Thus, the expansion members 260 are operable to provide a zero extrusion gap for the sealing element 270 when deployed in the set configuration.

Figure 5:
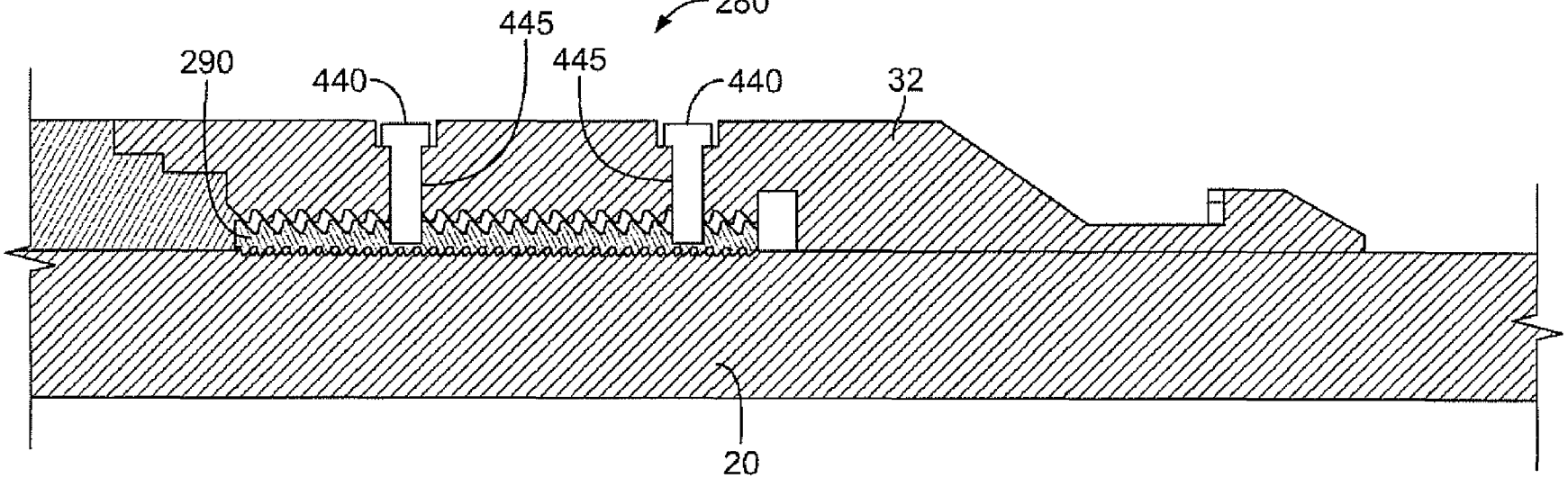
FIG. 5 is a detail view of a locking ring system.
Figure 6:
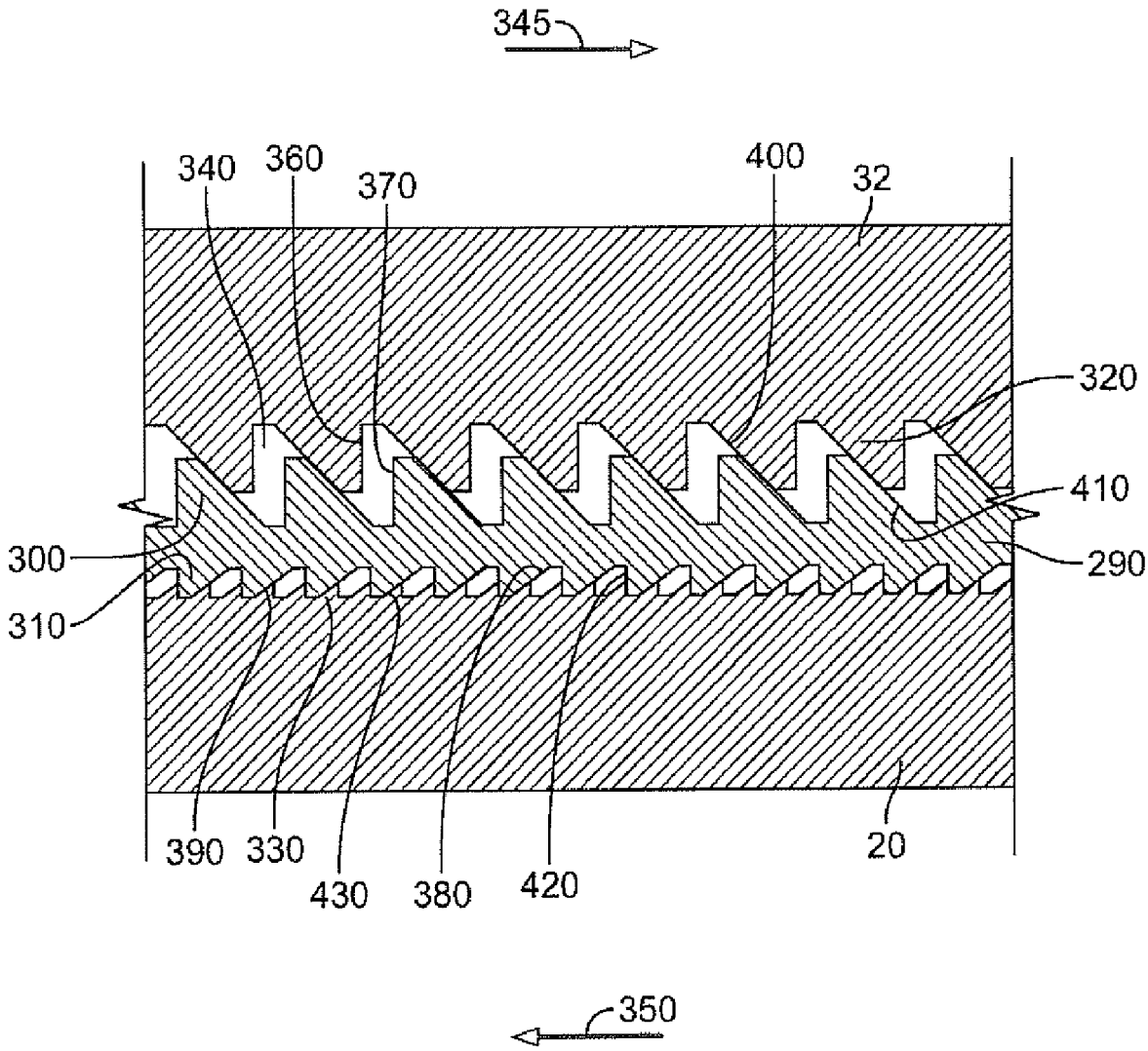
FIG. 6 is a detail view of various components of the locking ring system of FIG. 5.
Figure 7A:
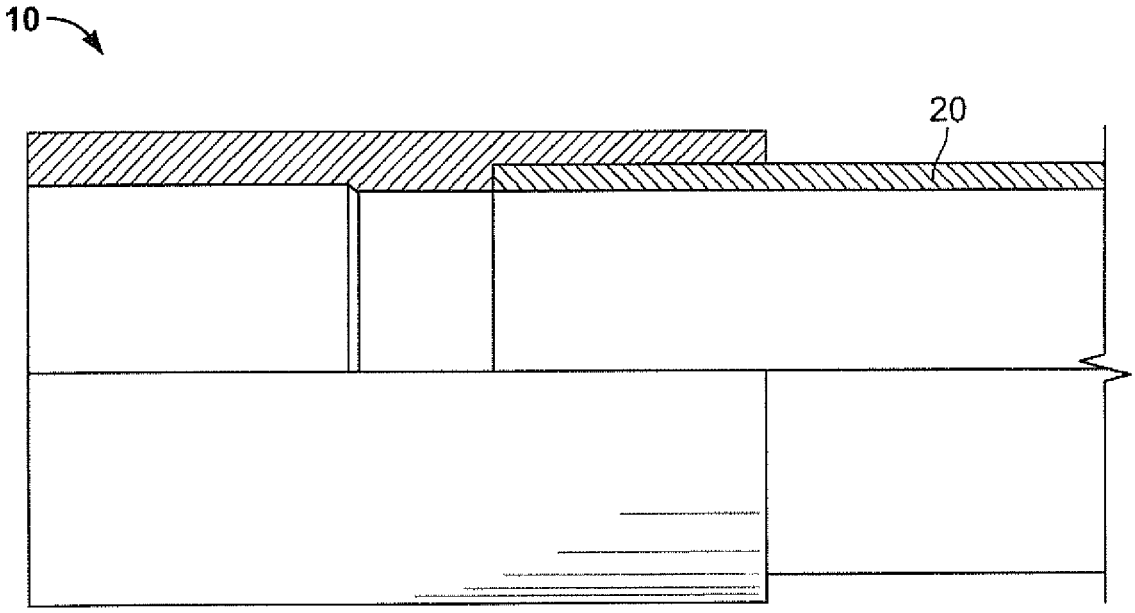
FIG. 7A-D shows an example downhole tool in the running configuration that is fluidically actuated and set from the top-down.
Figure 7D:
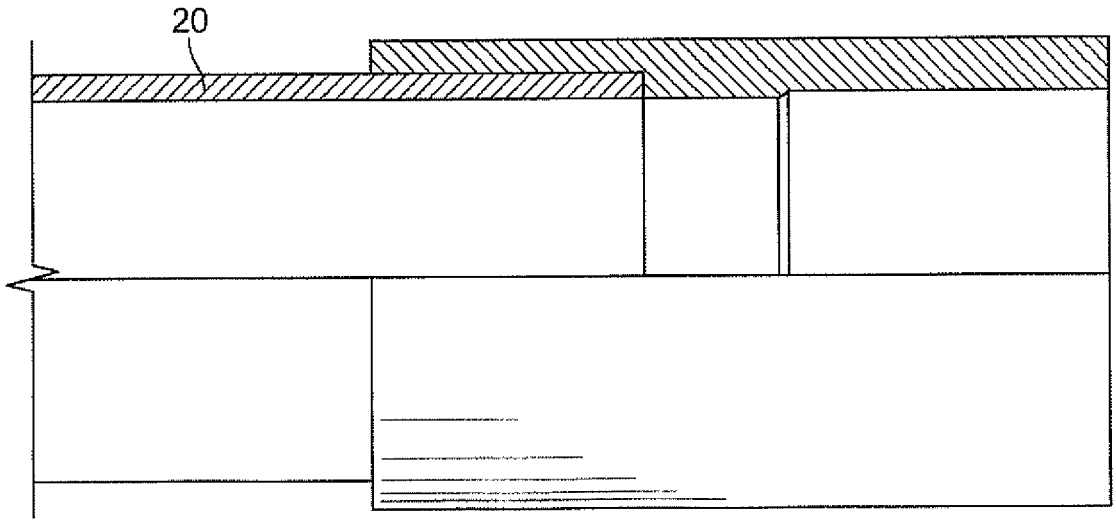
Figure 7B:
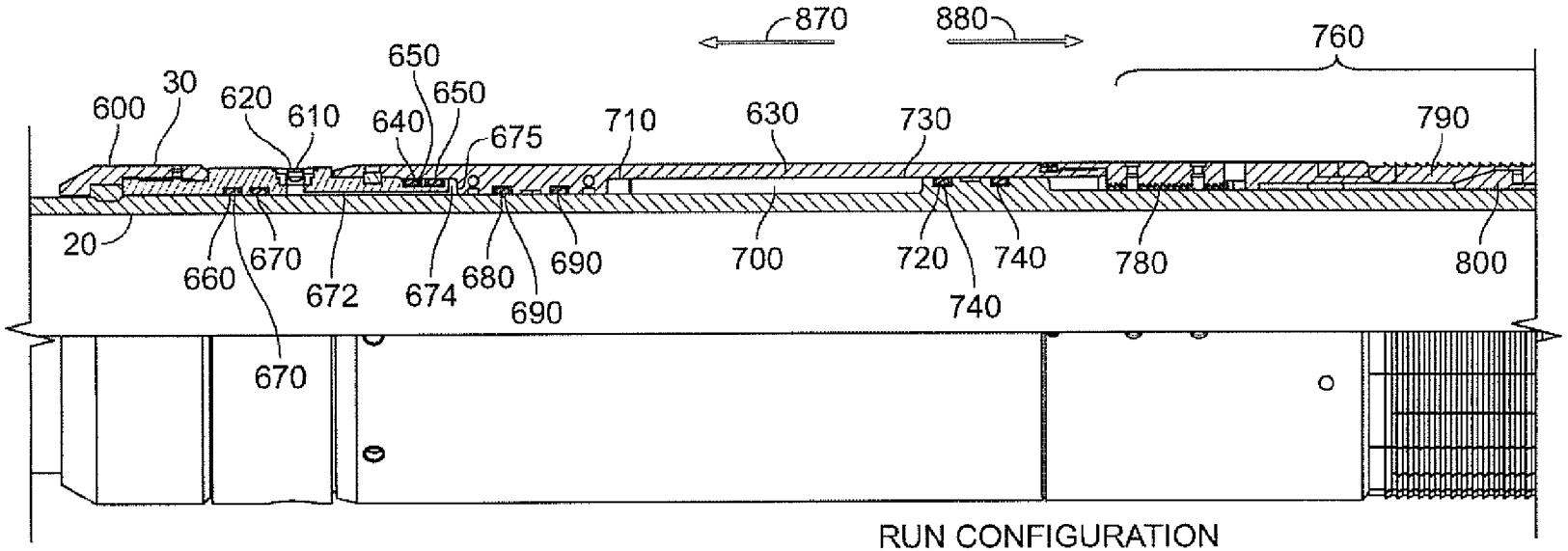
Figure 7C:
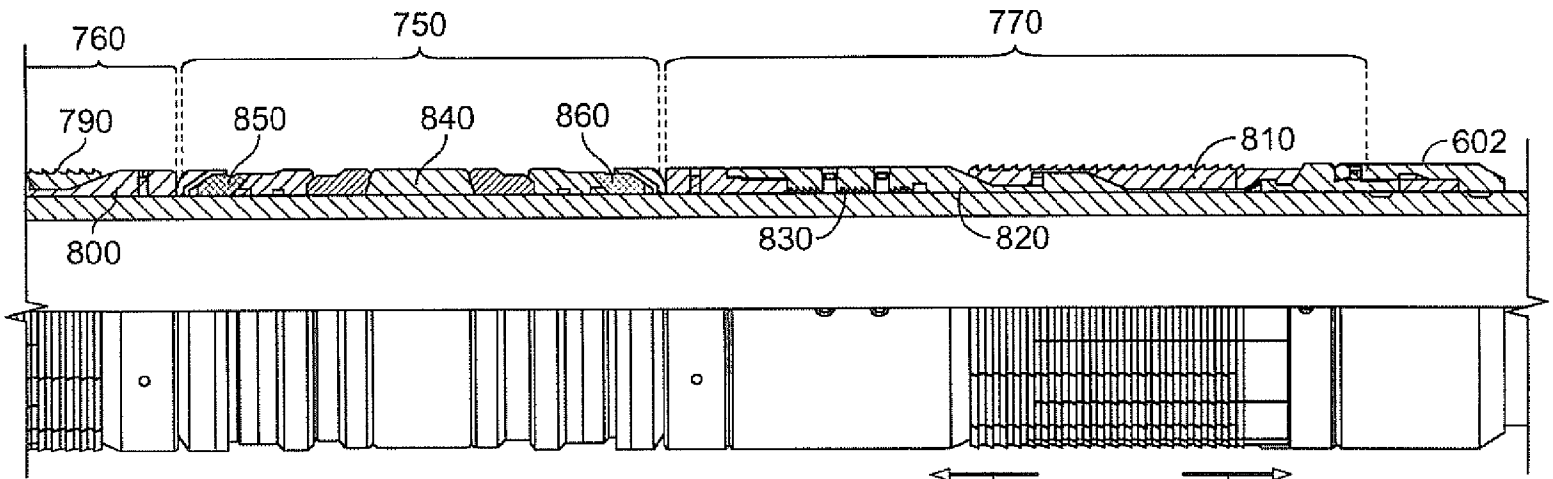
Figure 8A:
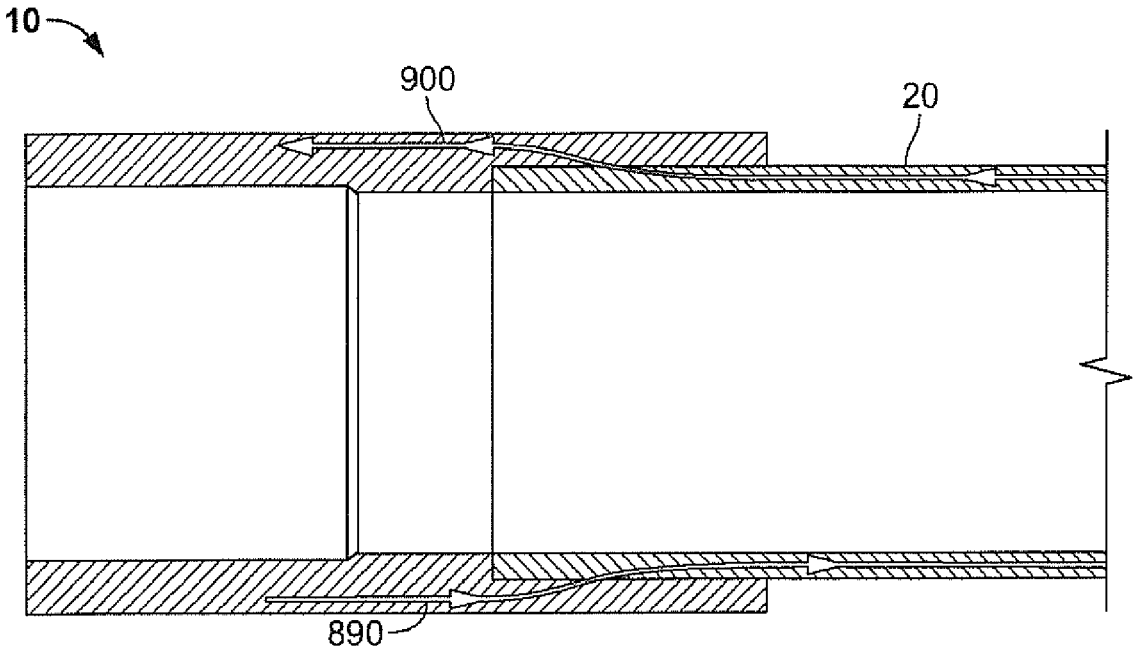
FIGS. 8A-D shows the downhole tool of FIGS. 7A-D in the set configuration.
Figure 8D:
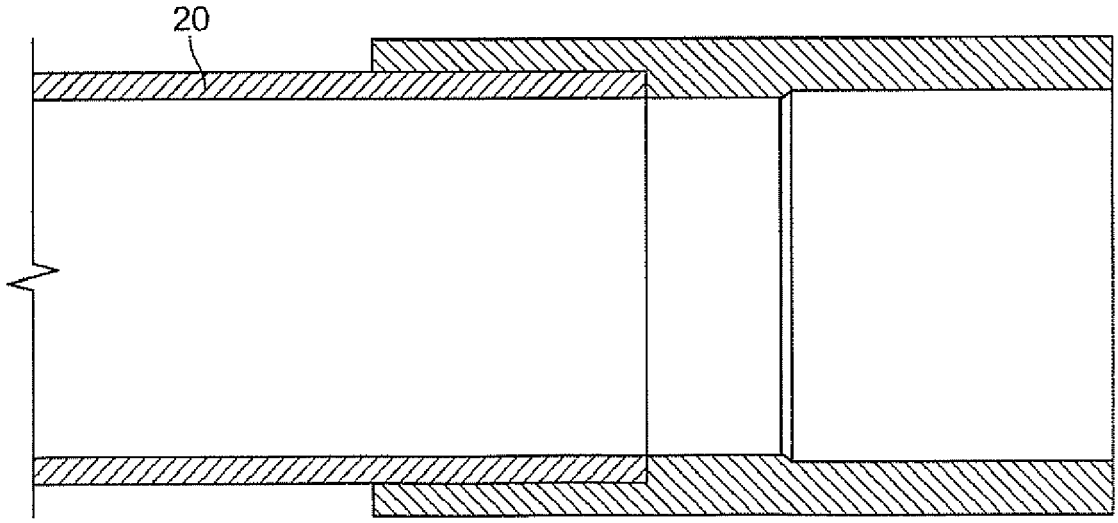
Figure 8B:
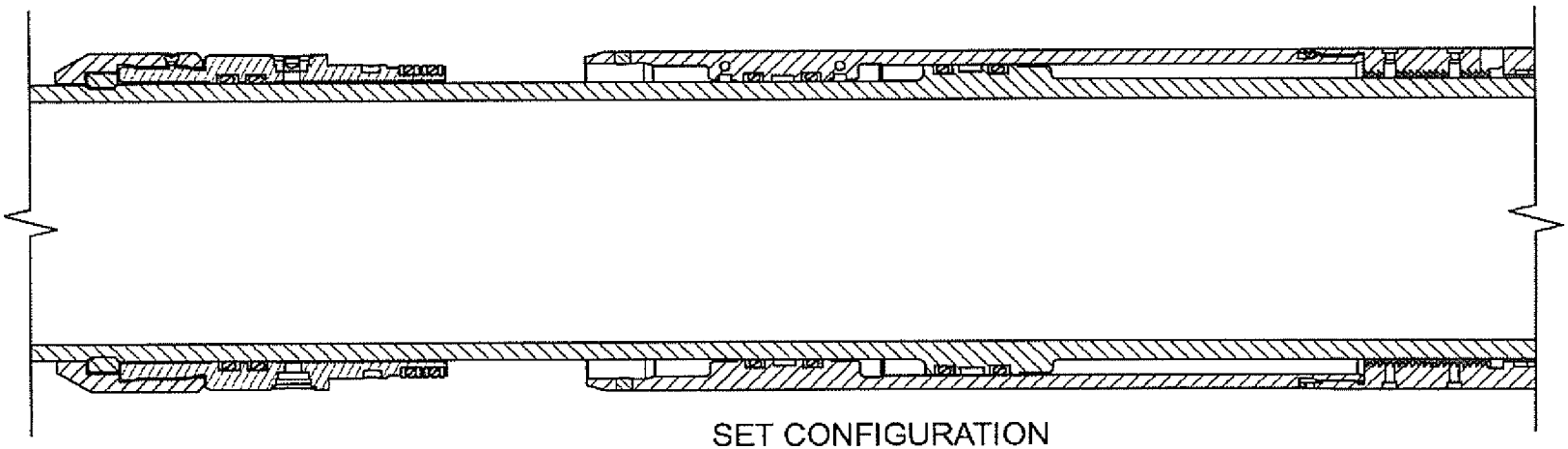
Figure 8C:
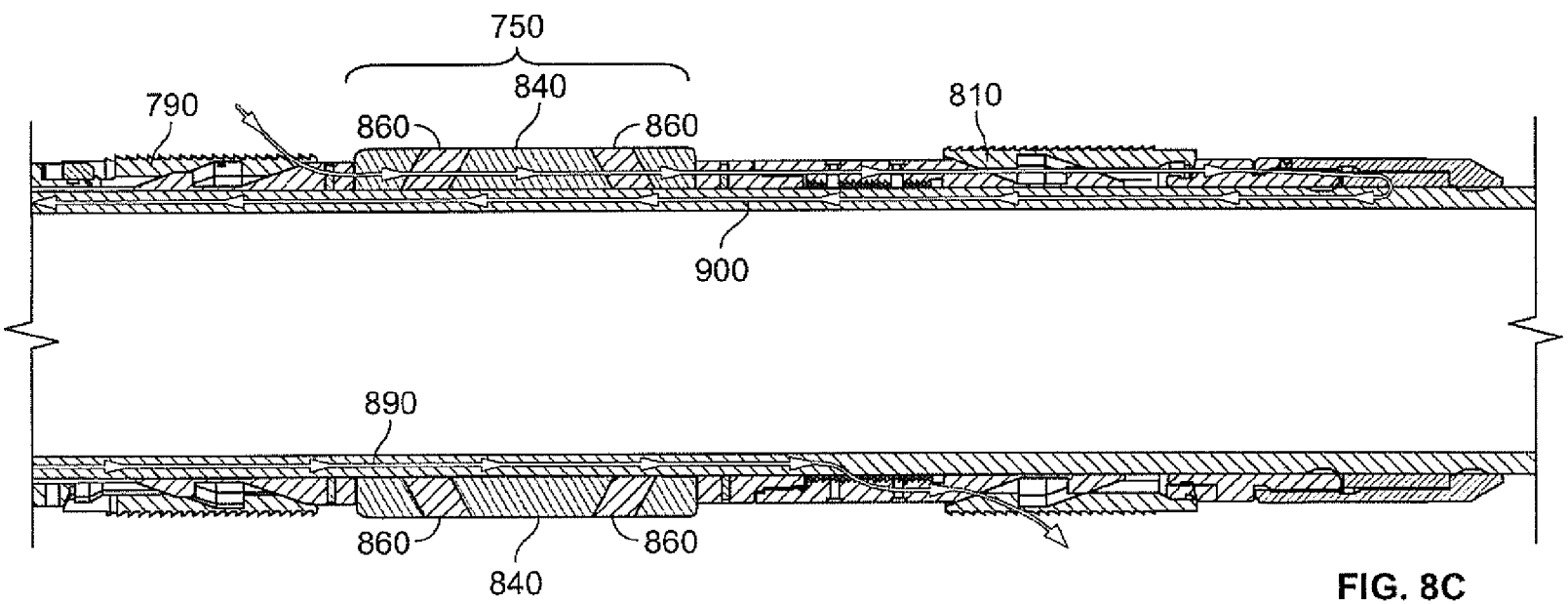
Figure 9A:
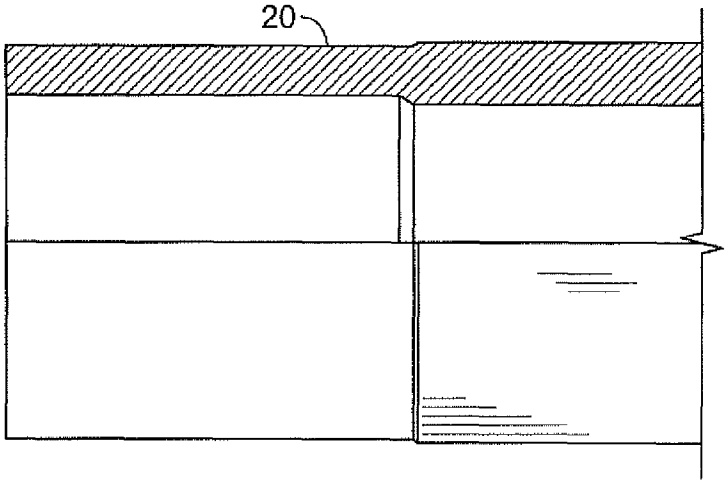
FIGS. 9A-D shows an example downhole tool in a running configuration that is fluidically actuated and set from the bottom-up.
Figure 9B:
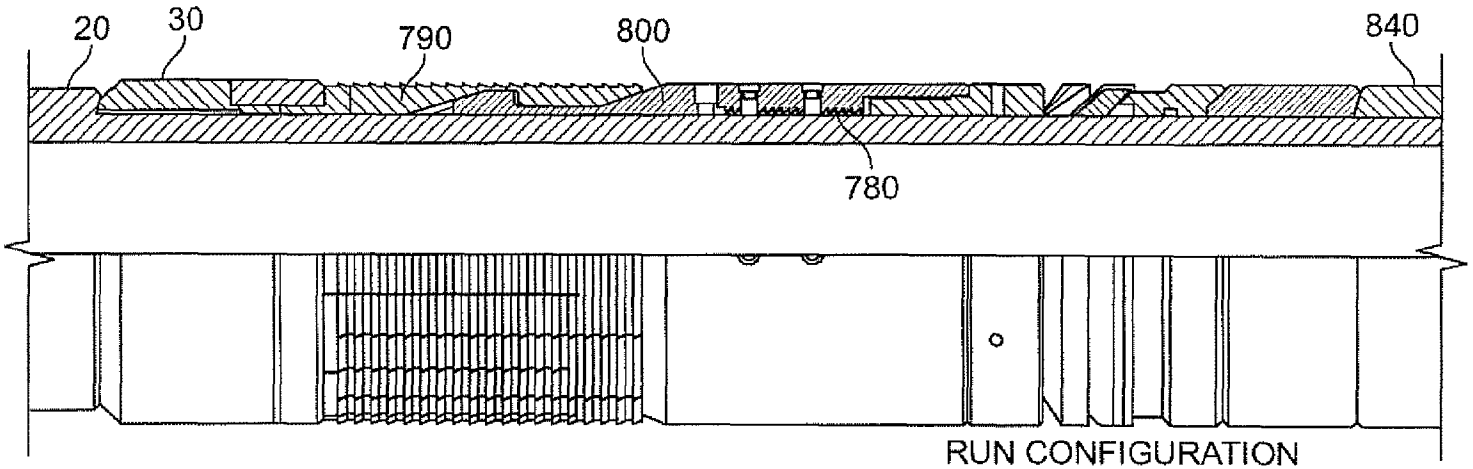
Figure 9C:
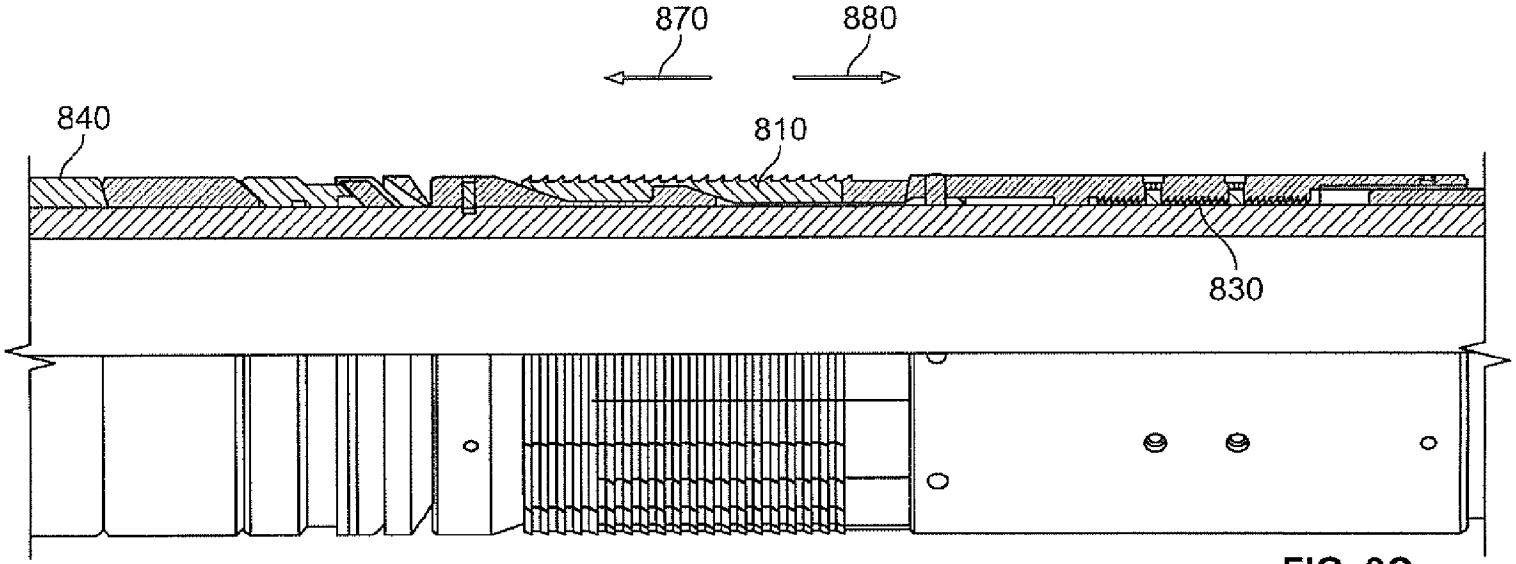
Figure 9D:
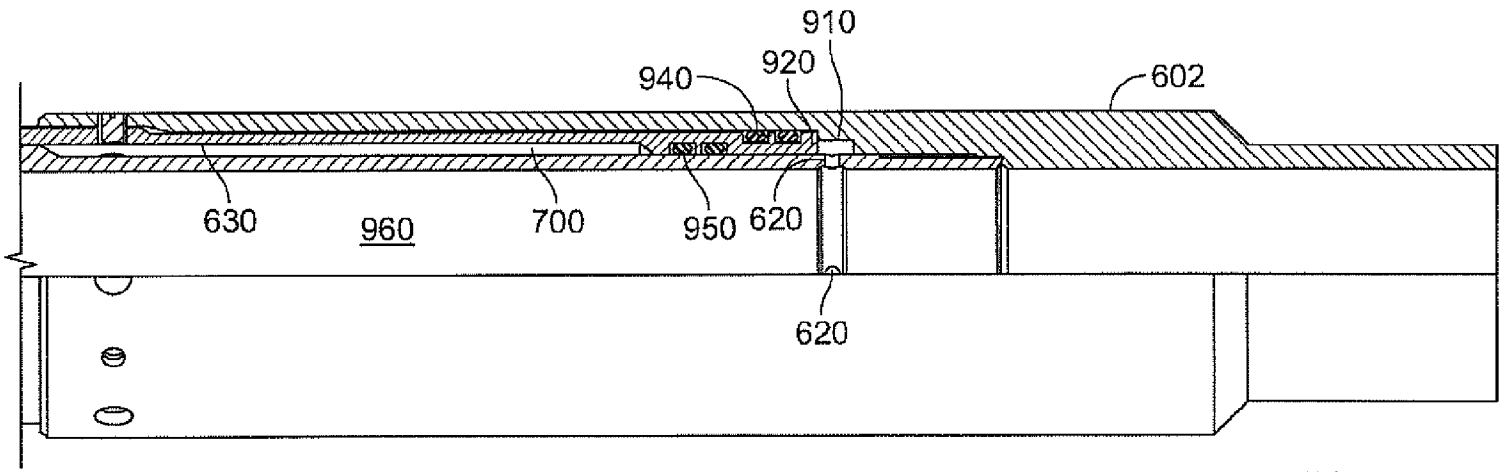
Figure 10A:
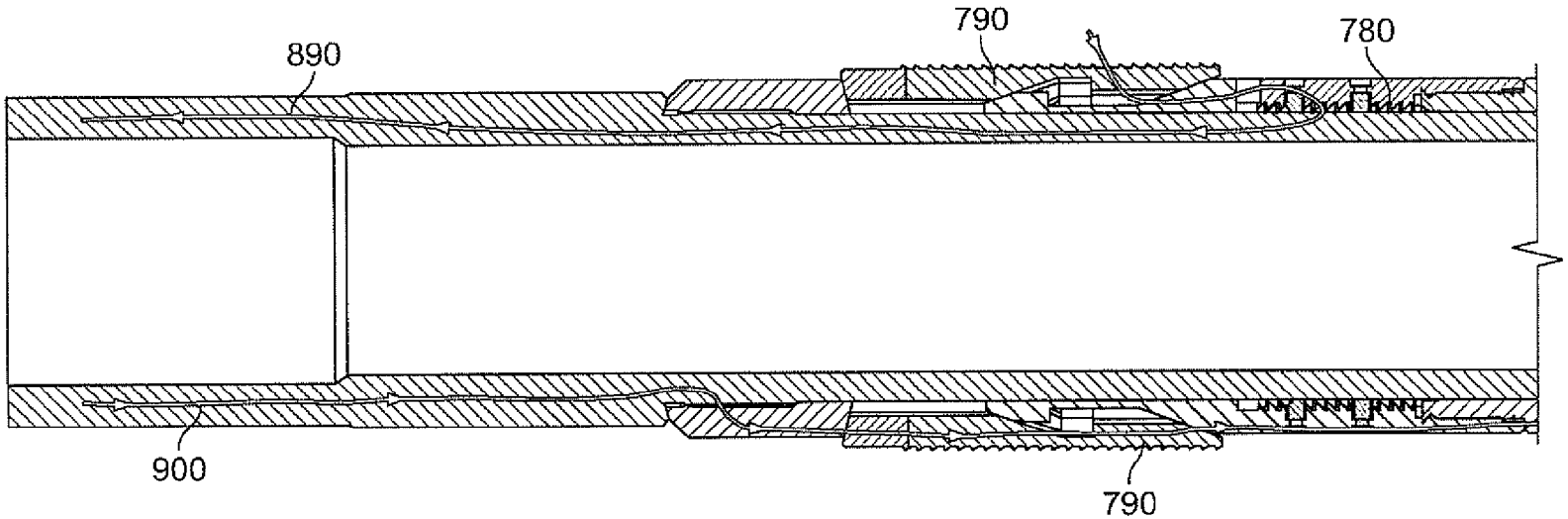
FIGS. 10A-C shows the downhole tool of FIGS. 9A-D in the set configuration.
Figure 10B:
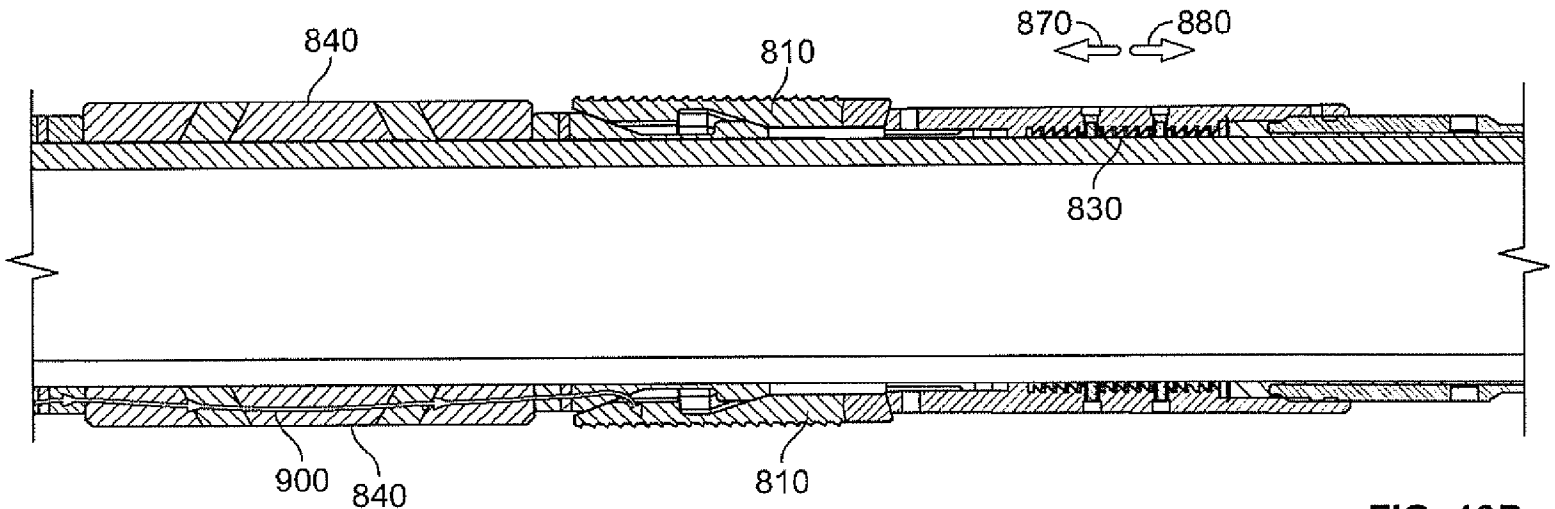
Figure 10C:
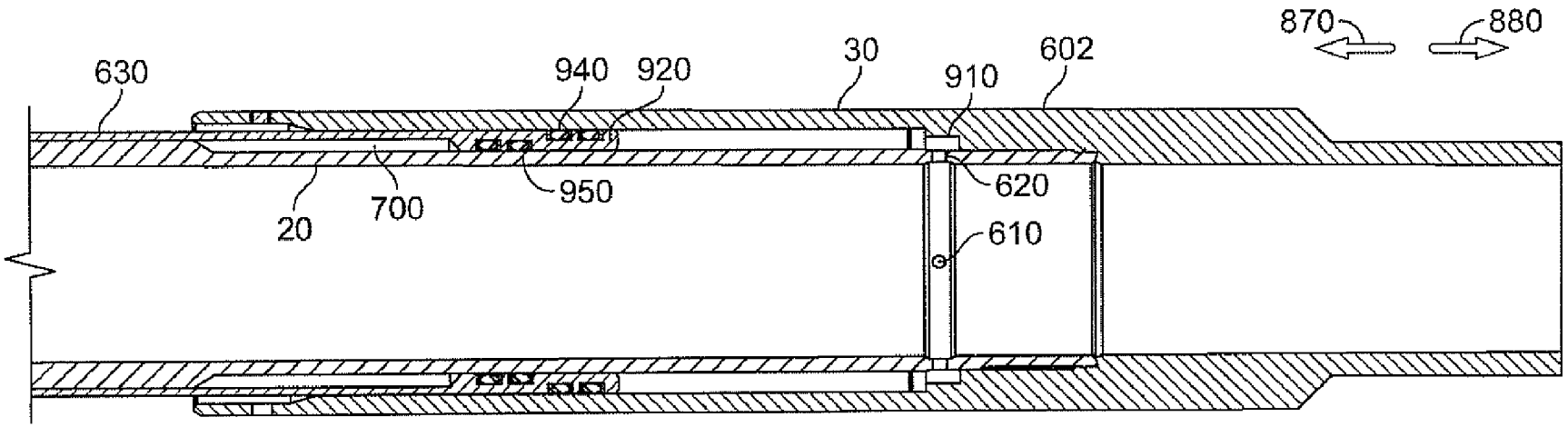

The downhole tool 10 also includes a locking ring system 280 that includes a locking ring 290 disposed between a portion 32 of the tubular housing 30 and the tubular mandrel 20. The locking ring 290 has a through-slit (not shown) extending an entire length of the locking ring 290 so that the locking ring 290 has a "C" shape in profile. The locking ring 290 may also include a plurality of slits, similar to the slits 200 described above with respect to the first slip 140. FIGS. 5 and 6 show an example implementation of the locking ring system 240.

Referring to FIGS. 5 and 6, the locking ring 290 includes a plurality of coarse asymmetrical teeth 300 formed on an external surface thereof and a finer plurality of asymmetrical teeth 310 formed on an inner surface of the slip ring 240. The teeth 290 engage mating asymmetrical teeth 320 formed on an inner surface of the portion 32 of the tubular housing 30, and the teeth 310 engage asymmetrical teeth 330 formed on an exterior surface of the tubular mandrel 20. Any of the teeth 300-330 may be formed in a manner similar to the teeth 70, 170 described above. For example, the teeth 300-330 may be formed from a plurality of coaxial annular rings formed along the locking ring 290 or, alternatively, from one or more continuous helical threads. It should be apparent that if teeth 300 or 310 are formed from one or more continuous helical thread, the mating teeth 320 or 330 would also be formed from one or more continuous helical threads. Similarly, if the teeth 300 or 310 were formed from a plurality of coaxial rings, the mating teeth 320 or 330 would also be formed from a plurality of coaxial rings.

In the example implementation shown, a gap 340 is formed between the mating teeth 300 and 320, and the teeth 310 and 330 have relative sizes such that two teeth 330 fit into the space formed between adjacent teeth 310. The implementation shown, though, represents only one possible implementation and is not meant to limit the scope of the disclosure. For example, the relative sizes of teeth 310 and 330 may be such that more or less than two teeth 330 may reside in the space formed between adjacent teeth 310.

Further, the portion of the tubular mandrel 20, the portion 32 of the tubular housing 30, and the locking ring 290 forming the locking ring system 280 have defined rigidities so that locking ring system 280 performs a ratcheting action as the portion 32 of the tubular housing 30 and the tubular mandrel 20 move relative to each other in a defined direction. Particularly, as the tubular housing 20 moves in a direction indicated by arrow 345 and as the tubular mandrel 20 moves relative according to the direction indicated by arrow 350, vertical or substantially vertical side 360 of teeth 320 engage vertical or substantially vertical side 370 of teeth 300. As the portion 32 of the tubular housing 30 continues to move, the sloped portion 380 of teeth 310 slip over the sloped portion 390 of the teeth 330, causing the locking ring 290 to expand into the gap 340 until the locking ring 290 moves the distance of one of the teeth 330. When the locking ring 290 moves past a tooth 330, the teeth 310 fall back into the spaces formed between adjacent teeth 330, permitting the locking ring 290 to radially contract. On the contrary, when the portion 32 of the tubular housing 30 is moved in a direction opposite arrow 345, sloped portion 400 of the teeth 320 engage sloped portion 410 of teeth 300 causing the vertical or substantially vertical side 420 of teeth 310 to engage the vertical or substantially vertical side 430 of teeth 330. The interaction of sides 420 and 430 prevent the locking ring 290 from moving relative to the tubular mandrel 20. Further, the tubular mandrel 20 is prevented from sliding relative to the locking ring 290 due to the relative rigidities of the tubular mandrel 20, the tubular housing 30 (e.g., the portion 32), and the locking ring 290. Thus, a wall thickness of the locking ring 290, the tubular mandrel 20, and the portion 32 of the tubular housing 30 as well as the geometry of teeth 300-330 are sized such that the locking ring 290 elastically deforms without yielding to permit movement of the portion 32 of the tubular housing 30 relative to the tubular mandrel 20 only in a one direction. Consequently, the locking ring system 290 is adapted to permit movement of the portion 32 of the tubular housing 30 relative to the tubular mandrel 20 in one direction, while preventing relative movement in an opposite direction.

Additionally, the downhole tool 10 may include pins 440 extending through openings 445 formed in the portion 32 of the tubular housing 30 and into the through-slit formed in the locking ring 290. The pins 440 prevent rotation of the locking ring 290 relative to the portion 32 of the tubular housing 30 as the portion 32 of the tubular housing 30 and the tubular mandrel 20 move relative to each other, as described above. A rotational tendency may be present when, for example, the teeth pairs 300 and 320 and/or 310 and 330 are formed from one or more continuous helical threads.

The downhole tool 10 also includes a second slip 450. The second slip 450 may be configured similar to the first slip 140 having slits 460 and 470 corresponding to slits 200 and 210, respectively. The second slip 450 may or may not include shear pins, similar to shear pins 220, provided on opposing sides of the slit 470. Similar to the first slip 140, the second slip 450 also includes an engaging portion 480 that may include a plurality of engaging members or teeth 490. Teeth 490 may be asymmetrical in shape. Similar to teeth 170, the teeth 490 may be formed from a series of coaxial annular rings formed on the external surface of the slip 450 or may be one or more continuous helical threads. Also, the teeth 490 are oriented in an opposite direction as the teeth 170 formed on the first slip 140. Thus, movement of second slip 450 in the direction of arrow 110 causes the teeth 490 to "bite" into the casing of the wellbore.

A second wedge ring 500, similar to the first wedge ring 150, is disposed adjacent the tubular housing 30 and tubular mandrel 20. The second slip 450, second wedge ring 500, and locking ring system 280 form a second slip assembly 505. Similar to the first wedge ring 150, the second wedge ring 500 includes two wedge-shaped protrusions 510 that nest in wedge-shaped recesses 520 formed in the second slip 450. More or fewer wedge-shaped protrusions 510 and corresponding wedge-shaped recesses 520 may be used. A second end portion 530 of the tubular housing 30 is secured to the tubular mandrel 20, such as by a threaded connection, welding, or other connection technique. Thus, the second end portion 530 of the tubular housing 30 is prevented from moving relative to the tubular mandrel 20.

The tubular housing 30 and the tubular mandrel 20 are temporarily held fixed relative to each other with one or more shear pins 540 or other device, for example, until movement of the tubular housing 30 and the tubular mandrel 20 relative to each other is desired. When the relative movement is desired, a force greater than the shearing strength of the shear pins 540 is applied, causing the shear pins 540 to break and the tubular housing 30 operable to move relative to the tubular mandrel 20.

In operation, a wireline actuation tool (not shown), coupled to the downhole tool 10, is actuated. In some implementations, the wireline actuation tool may engage a profile or other geometry of the tubular mandrel 20 and a profile or other geometry of the tubular housing 30 to displace the tubular mandrel 20 and the tubular housing 30 relative to each other. As explained above, the downhole tool 10 has a top-down set configuration such that the wireline actuation tool applies a force to the tubular housing 30 in the direction of arrow 110 and a force to the tubular mandrel 20 in the direction of arrow 120. This force exceeds the strength of the shear pins 540, causing them to shear or otherwise break, allowing the tubular housing 30 to move relative to the tubular mandrel 20. Because the second end portion 530 of the tubular housing 30 is fixed to the tubular mandrel 20, as the tubular housing 30B moves down the tubular mandrel 20, the wedge-shaped protrusions 510 of the second wedge ring 500 force the second slip 450 to expand outwardly and engage the interior surface of the wellbore casing. As the second slip 450 is driven into the wellbore casing, the second wedge ring 500 is prevented from traveling further along the tubular mandrel 20 due to engagement of the wedge-shaped protrusions 520 with the wedge-shaped recesses of the second slip 450. Further, the teeth of the second slip 450 are oriented so that the teeth 49 "bite" into the interior wall of the wellbore casing.

As the second slip 450 begins to expand and movement of the second wedge ring 500 along the tubular mandrel 20 begins to slow, the sealing assembly 250 is squeezed between opposing shoulders 550 and 560. The expansion members 260 and the resilient sealing element 270 are expanded radially outwards so that resilient sealing element 270 also engages the interior surface of the wellbore casing to form a seal. The first slip 140 also expands radially outwardly as the first slip 140 is pushed outwardly by the wedge-shaped protrusions 230 of the first wedge ring 150.

The slip ring 50 is also driven downwardly by the retaining ring 125 that is attached to the tubular housing 30. Thus, when the tubular mandrel 20 and tubular housing 30 move relative to each other, the retaining ring 125 contacts and drives the slip ring 50 along the exterior surface of the tubular mandrel 20. The orientation of the teeth 70 permits the slip ring 50 to travel along the tubular mandrel 20 in the direction of arrow 110 without binding.

In the set configuration, relative movement between the tubular housing 30 and the tubular mandrel 20 is resisted by the engagement portion 70. That is, movement of the tubular housing 30 relative to the tubular mandrel 20 in the direction of arrow 120 causes the teeth 70 to "bite" into and engage the exterior surface of the tubular mandrel 20. Further, relative movement between the tubular housing 30 and the tubular mandrel 20 is resisted by the first and second slips 140 and 450. Moreover, a force in the direction of arrow 110 applied through the tubular mandrel 20 is transmitted through rigid elements of the downhole tool 10, thereby bypassing the resilient sealing element 270.

For the top-down set downhole tool 10 illustrated in FIGS. 2A-C and 3A-C, a force through the tubular mandrel 20 in the direction of arrow 110 (i.e., compressive loading) bypasses the resilient sealing element 270. The corresponding load path is shown as arrow 550 in FIG. 3A-C. As shown, the compressive loading passes from the tubular mandrel 20, through the locking ring system 280, and into the second slip 450. When a compressive load applied to the tubular mandrel 20, the tubular mandrel 20 and the tubular housing 30 are prevented from relative movement because the slip ring 50 lockingly engages the tubular mandrel 20 via the teeth 70. The compressive load passes through the locking ring system 280 as a result of the locking functionality of the locking ring system 280, described above. The load is transmitted from the locking ring system 280, into the second slip ring 450, and into the wellbore casing. As a result, a pressure increase to the resilient sealing element 270 and the formation of gaps between the first and second slips 140 and 450 and the first wedge ring 150 and the second wedge ring 500, respectively, or between the first slip assembly 760 or the second slip assembly 770 and adjacent portions of the tubular housing 30 are avoided. Such loading and mandrel movement may occur during load reversals imparted to the working string, such as working string 4 in FIG. 1, during wellbore operations. Downhole tool 10 also enjoys the benefit of significantly reduced movement of the tubular mandrel 20 when the resilient sealing element 270 experiences load and/or pressure reversals. Further, the durability of the resilient element 270 is improved due to the reduced stress and movement of the tubular mandrel 20, which ultimately improves the long term sealability of the resilient sealing element 270, increases resistance to tubular mandrel collapse, as well as increased resistance to wellbore casing burst. On the other hand, tensile loading, i.e., loading the tubular mandrel 20 in the direction of arrow 120 (shown as load path 560) passes from the tubular mandrel 20, the second end portion 530 of the tubular housing 30, the second slip 450, the second wedge 500, the sealing assembly 250, the first wedge 150, and through the first slip 140. During tensile loading to the tubular mandrel 20, the tubular mandrel 20 may move relative to the slip ring 50. In the example shown, the movement would be uphole movement, i.e., towards the terranean surface. Once the movement uphole movement of the tubular mandrel 20 ceases, the slip ring 50 again grips the tubular mandrel 20, preventing the tubular mandrel 20 from returning to its original position prior to the application of the tensile loading.

It is noted that, in wellbore operations, the most significant loading direction to the tubular mandrel 20 after setting the downhole tool 10 is generally known. Thus, the downhole tool 10 used in a particular application can be selected from one of a top-down set or bottom-up set type. An example bottom-up set type downhole tool is described below with respect to FIGS. 9A-D and 10A-C.

FIGS. 7A-D and 8A-D illustrate a further implementation of the downhole tool 10 that is hydraulically actuated. The downhole tool 10 shown in FIGS. 7A-D and 8A-D is configured to be set from the top-down. This downhole tool 10 also has a tubular mandrel 20 and a tubular housing 30 circumjacent the tubular mandrel 20. The downhole tool 10 may be provided on a tubular working string for running the downhole tool 10 into position downhole in the wellbore.

First and second portions 600, 602 of the tubular housing 30 are coupled to the tubular mandrel 20 such as by a treaded connection, welding, or any other coupling technique. The first portion 600 of the tubular housing 30 includes a pressure sensitive valve 610 disposed in a port 620. In some implementations, the pressure sensitive valve is a rupture disk. The rupture disk may be configured to rupture when the rupture disk experiences a desired pressure difference between an exterior of the downhole tool 10 and a pressure interior of the rupture disk. In some implementations, the pressure differential may be selected to be 1500 to 2000 psi greater than an expected downhole pressure. A piston member 630 of the tubular housing 30 adjacent the first portion 600 is moveable relative to the first portion 600. As shown, the piston member 630 overlaps an end of the first portion 600. A first seal 640 is formed between the first portion 600 and piston member 630 by one or more sealing members 650. According to some implementations the one or more sealing members 650 may be one or more o-ring or other resilient sealing members. A second seal 660 is also formed between an interior surface of the first portion 600 and an exterior surface of the tubular mandrel 20. The second seal 660 may be formed by one or more sealing members 670. The sealing members 670 may be similar to or different from the sealing members 650. A third seal 680 is formed between an interior surface of the piston member 630 and an exterior surface of the tubular mandrel 20. The seal 680 may be formed from one or more sealing members 690, which may be similar to or different from the sealing members 650 and/or 670. An annular channel 672 is formed between the first portion 600 and the tubular mandrel 20 and is in communication with the port 620. The annular channel 672 extends to an annular gap 674 bounded by the first portion 600, the piston member 630, and the tubular mandrel 20. The annular channel 672 is sealed by the first, second, and third seals 640, 660, and 680.

An annular chamber 700 is formed between the piston member 630 and the tubular mandrel 20. In some implementations, the annular chamber 700 has a low internal pressure. In some implementations, the annular chamber 700 has zero pressure or substantially zero pressure. The third seal 680 is formed at a first end 710 of the annular chamber 700 and a fourth seal 720 is formed at a second end 730 of the annular chamber 700. The fourth seal 720 may be formed from one or more sealing members 740, similar to or different from the sealing members 650, 670, and/or 690. Thus, the third and fourth seals 680 and 720 are operable to isolate the annular chamber 700.

The downhole tool 10 also includes a sealing assembly 750 flanked on opposite sides by a first slip assembly 760 and a second slip assembly 770. The sealing assembly 750 and first and second slip assemblies 760 and 770 are provided on the tubular mandrel 20. The first and second slip assemblies 760, 770 are substantially the same as and operate similarly to the first and second slip assemblies 155 and 505 with the exception that, in the shown implementation, the first slip assembly 760 includes a locking ring system 780 rather than the slip ring 50. However, according to other implementations, a slip ring similar to slip ring 50 may be used in place of the locking ring system 780. Thus, the first slip assembly 760 includes a first slip 790, a wedge ring 800, and the locking ring system 780. The second slip assembly 770 includes a second slip 810, a second wedge ring 820, and a locking ring system 830. Likewise, the sealing assembly 750 may be similar to the sealing assembly 250. Thus, the sealing assembly 750 may include a resilient sealing element 840 with expansion members 850, 860 on opposing sides thereof, although the expansion members 850, 860 may be omitted.

The locking ring system 780 corresponds essentially to the locking ring system 280, illustrated in FIGS. 2A, 3A, 5, and 6. Thus, the locking ring system 780 is adapted to allow the first slip assembly 760 to move relative to the tubular mandrel 20 in the direction of arrow 880 but not in the direction of arrow 870.

In operation, the downhole tool 10 is placed into a desired position downhole. A pressure in the wellbore is increased to a pressure that causes the pressure sensitive valve 610 to open. In the implementation shown, the downhole pressure is increased to a pressure designed to rupture the rupture disk. Wellbore pressure is communicated through the pressure sensitive valve 610 into the port 620, through the annular channel 672 and into the annular gap 674. The wellbore pressure acts on the surface 675. Because the pressure within the annular chamber 700 is zero or substantially zero, there is little to no resistance to the piston member 630 moving in the direction of arrow 880 relative to the tubular mandrel 20; consequently, the first and second slip assemblies 760 and 770 are moved relative to the tubular mandrel 20, causing the associated slips to radially expand and engage the wellbore casing. The sealing assembly 750 is also actuated to form an annular seal within the wellbore casing. The locking ring systems 780, 830 of the first and second slip assemblies 760 and 770, respectively, permit movement of the tubular housing 30 along the tubular mandrel 20 in the direction of arrow 880 but not in the direction of arrow 870. Thus, the locking ring systems 780, 830 lock the first and second slip assemblies 760, 770 and the sealing assembly 750 into position when the downhole tool 10 is placed in the set configuration. FIG. 8A-8D shows the wellbore tool 10 in the set configuration.

A compression force applied to the tubular mandrel 20 is directed through the locking ring system 830, through the second slip 810, and into the wellbore casing, thereby bypassing the resilient sealing element 840 of the sealing assembly 750, as illustrated by the load path 890. Conversely, a tensile force applied through the tubular mandrel 20 passes through the second portion 602 of the tubular housing 30, the second slip 810, the second wedge 820, the sealing assembly 750, the first wedge 800, and the first slip 790 into the casing wall, illustrated by load path 900.

FIGS. 9A-D and 10A-C show another implementation of the downhole tool 10 that is fluidically actuated. The downhole tool 10 of FIGS. 9A-D and 10A-C is similar to the downhole 10 of FIGS. 7A-D and 8A-D except that the downhole tool 10 of FIGS. 9A-D and 10A-C is set from the bottom-up. As a result, the ratcheting direction of the first and second locking ring systems 780 and 830 is reversed. One or more ports 620 is in communication with the interior 960 of the tubular mandrel 20. In some instances, a pressure sensitive valve 610 may be disposed in the port 20. The port 620 is in communication with annular passage 910, which is defined between the second portion 602 of the tubular housing 30 and an end 920 of the piston member 630. The annular passage 910 may be isolated from the exterior of the downhole tool 10 and the annular channel 700 by seals 940, 950. The end 920 is sandwiched between the second portion 602 of the tubular housing 30 and the tubular mandrel 20. The annular chamber 700 is defined between the piston member 630 and the exterior surface of the tubular mandrel 20.

Thus, when fluid pressure is applied to the interior of the tubular mandrel 20, the pressure sensitive valve 610 opens (if provided) and fluid pressure is communicated to the end 920 of the piston member 630 via the one or more ports 620 and annular passage 910. The piston member 630 slides relative to the tubular mandrel 20 in the direction of arrow 870 (uphole towards the terranean surface), thereby placing the downhole tool 10 in the set configuration (shown in FIGS. 10A-D). A subsequent tensile load to the tubular mandrel 20 after the downhole tool 10 has been placed in the set configuration follows the load path 890 through the first locking ring system 780, the first wedge 800, the first slip 790, and into the wellbore casing, thus avoiding the resilient sealing element 840. A compressive load applied to the tubular mandrel 20, on the other hand, passes through the resilient sealing element 840, as indicated by the load path 900, and through the second slip 810.

A number of implementations have been described. Nevertheless, it will be understood that various modifications may be made without departing from the spirit and scope of the disclosure. For example, although not shown, implementations on a wireline or tubing string and set from the bottom-up are also within the scope of the present disclosure. Accordingly, other implementations are within the scope of the following claims.

What is claimed is:

1. A downhole tool comprising:

an elongated mandrel;

a first slip assembly carried on the mandrel and having a first slip radially extendable to grip a wall of a wellbore and a first engaging portion, the first engaging portion adapted to grip the mandrel against relative movement in a first axial direction and allow relative movement of the mandrel in a second axial direction;

a second slip assembly carried on the mandrel and having a second slip radially extendable to grip the wall of the wellbore and a second engaging portion, the second engaging portion adapted to grip the mandrel against relative movement in the first axial direction and allow relative movement of the mandrel in the second axial direction;

a sealing element carried on the mandrel adapted to engage the wall of the wellbore, wherein the first slip assembly and the second slip assembly cooperate to form a first load path bypassing the sealing element when the mandrel is loaded in the first axial direction and a second load path including the sealing element when the mandrel is loaded in the second axial direction.

2. The downhole tool of claim 1, wherein the sealing element is positioned between the first slip assembly and the second slip assembly.

3. The downhole tool of claim 1, wherein one of the first engaging portion or the second engaging portion comprises a wedge that grips the mandrel.

4. The downhole tool of claim 3, wherein the wedge is disposed radially between the mandrel and a housing of the downhole tool.

5. The downhole tool of claim 4, wherein the wedge is adapted to grip the mandrel against movement of the housing in the second axial direction relative to the housing.

6. The downhole tool of claim 1, wherein at least one of the first slip assembly, the second slip assembly, or the sealing element is adapted to be actuated fluidically.

7. The downhole tool of claim 1, wherein at least one of the first slip assembly, the second slip assembly, or the sealing element is adapted to be actuated by a wireline actuation tool.

8. The downhole tool of claim 1, wherein at least one of the first engaging portion or the second engaging portion is adapted to ratchet in the second axial direction relative to the mandrel.

9. A method for diverting loading in a first direction around a sealing element of a downhole tool, the method comprising:

applying a setting load in a first direction through a mandrel to extend the sealing element into contact with an adjacent surface and form a first gripping engagement with the adjacent surface on a first side of the sealing element towards the first direction, and a second gripping engagement with the adjacent surface on a second side of the sealing element opposite the first direction;

resisting relative movement of the mandrel in the first direction, while allowing relative movement of the mandrel opposite the first direction, by a first engagement portion adjacent the first side of the sealing element and a second engagement portion adjacent the second side of the sealing element;

communicating loading through the mandrel in the first direction through the sealing element and the first gripping engagement; and communicating loading through the mandrel in the second direction through the second gripping engagement and bypassing the sealing element.

10. The method of claim 9, wherein the adjacent surface is an interior surface of a wellbore casing.

11. The method of claim 9, wherein forming the first gripping engagement with the adjacent surface comprises radially expanding a first engagement member on the first side of the sealing element to grip the adjacent surface and wherein forming the second gripping engagement with the adjacent surface comprises radially expanding a second engagement member on the second side of the sealing element to grip the adjacent surface.

12. The method of claim 11 wherein radially expanding the first engagement member comprises ratcheting the first engagement member along a length of the mandrel in the second direction opposite the first direction.

13. The method of claim 11 wherein radially expanding the second engagement member comprises ratcheting the second engagement member along a length of the mandrel in the second direction opposite the first direction.

14. The method of claim 9, wherein applying the setting load in the first direction comprises fluidically applying the setting load.

15. A downhole tool configurable between an unset and set configuration and adapted to provide a seal downhole, the downhole tool comprising:

an elongated mandrel;

a first slip assembly carried on the mandrel comprising a first engagement portion, a first radially expandable engagement member adapted to grip a wall of a wellbore and a first wedge adapted to expand the first radially expandable engagement member;

a second slip assembly carried on the mandrel comprising a second engagement portion, a second radially expandable engagement member adapted to grip the wall of the wellbore and a second wedge adapted to expand the second radially expandable engagement member;

a sealing element carried on the mandrel and disposed between the first slip assembly and the second slip assembly, the sealing member adapted to radially expand to engage the wall of the wellbore;

a first load path extending through the second engagement portion and bypassing the sealing element in the set configuration to conduct loading applied to the mandrel in a first axial direction; and a second load path extending through the sealing element and the first engagement portion in the set configuration to conduct loading applied to the mandrel in a second axial direction.

16. The downhole tool of claim 15, wherein the first engagement portion is adapted to grip the mandrel against relative movement in the first axial direction and allow relative movement of the mandrel in the second axial direction opposite the first axial direction.

17. The downhole tool of claim 15, wherein the second engagement portion is adapted to grip the mandrel against relative movement in a first axial direction and allow relative movement of mandrel in a second axial direction opposite the first axial direction.

18. The downhole tool of claim 15, wherein the first slip assembly and the second slip assembly cooperate to radially expand the sealing element.

19. The downhole tool of claim 15, wherein at least one of the first slip assembly or the second slip assembly is adapted to ratchet along the mandrel in the first axial direction.

20. The downhole tool of claim 15, wherein at least one of the first slip assembly, the second slip assembly, or the sealing element is adapted to be actuated fluidically.

21. The downhole tool of claim 15, wherein at least one of the first engagement portion or the second engagement portion comprises a locking ring disposed adjacent the mandrel and operable to ratchet along the mandrel in the first axial direction.

22. The downhole tool of claim 15, wherein at least one of the first engagement portion or the second engagement portion comprises a wedge.

23. The downhole tool of claim 15 further comprising a housing carried on the mandrel and a channel having a substantially zero internal pressure is formed between the housing and the mandrel.

* * * * *